US010508536B2

(12) United States Patent
Morrow et al.

(10) Patent No.: US 10,508,536 B2
(45) Date of Patent: Dec. 17, 2019

(54) DISCRETE WELLBORE DEVICES, HYDROCARBON WELLS INCLUDING A DOWNHOLE COMMUNICATION NETWORK AND THE DISCRETE WELLBORE DEVICES AND SYSTEMS AND METHODS INCLUDING THE SAME

(71) Applicants: Timothy I. Morrow, Humble, TX (US); Renzo M. Angeles Boza, Houston, TX (US); Bruce A. Dale, Sugar Land, TX (US)

(72) Inventors: Timothy I. Morrow, Humble, TX (US); Renzo M. Angeles Boza, Houston, TX (US); Bruce A. Dale, Sugar Land, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 451 days.

(21) Appl. No.: 14/820,616

(22) Filed: Aug. 7, 2015

(65) Prior Publication Data

US 2016/0076363 A1 Mar. 17, 2016

Related U.S. Application Data

(60) Provisional application No. 62/049,513, filed on Sep. 12, 2014.

(51) Int. Cl.

| | |
|---|---|
| ***E21B 47/12*** | (2012.01) |
| ***E21B 47/09*** | (2012.01) |
| ***E21B 43/11*** | (2006.01) |

(52) U.S. Cl.

CPC ..... *E21B 47/12* (2013.01); *E21B 43/11* (2013.01); *E21B 47/09* (2013.01)

(58) Field of Classification Search

CPC ..... E21B 44/00; E21B 44/005; E21B 47/09; E21B 47/12

See application file for complete search history.

(56) References Cited

U.S. PATENT DOCUMENTS

| | | | |
|---|---|---|---|
| 5,995,449 | A | 11/1999 | Green et al. |
| 6,324,904 | B1 | 12/2001 | Ishikawa et al. |

(Continued)

FOREIGN PATENT DOCUMENTS

| | | | |
|---|---|---|---|
| WO | WO 2011/149597 | A1 | 12/2011 |
| WO | WO 2013/079928 | A2 | 6/2013 |

(Continued)

*Primary Examiner* — Robert E Fuller
*Assistant Examiner* — Lamia Quaim
(74) *Attorney, Agent, or Firm* — ExxonMobil Upstream Research Company—Law Department

(57) ABSTRACT

Discrete wellbore devices, hydrocarbon wells including a downhole communication network and the discrete wellbore devices, and systems and methods including the same are disclosed herein. The discrete wellbore devices include a wellbore tool and a communication device. The wellbore tool is configured to perform a downhole operation within a wellbore conduit that is defined by a wellbore tubular of the hydrocarbon well. The communication device is operatively coupled for movement with the wellbore tool within the wellbore conduit. The communication device is configured to communicate with a downhole communication network that extends along the wellbore tubular via a wireless communication signal. The methods include actively and/or passively detecting a location of the discrete wellbore device within the wellbore conduit. The methods additionally or alternatively include wireless communication between the discrete wellbore device and the downhole communication network.

7 Claims, 4 Drawing Sheets

(56) References Cited

U.S. PATENT DOCUMENTS

| | | | | |
|---|---|---|---|---|
| 6,470,996 | B1* | 10/2002 | Kyle | G01V 1/46 181/103 |
| 6,899,178 | B2 | 5/2005 | Tubel | |
| 6,956,791 | B2 | 10/2005 | Dopf et al. | |
| 6,980,929 | B2 | 12/2005 | Aronstam et al. | |
| 7,249,636 | B2 | 7/2007 | Ohmer | |
| 7,385,523 | B2 | 6/2008 | Thomeer et al. | |
| 7,411,517 | B2 | 8/2008 | Flanagan | |
| 8,237,585 | B2 | 8/2012 | Zimmerman | |
| 8,544,564 | B2 | 10/2013 | Moore et al. | |
| 8,683,859 | B2 | 4/2014 | Godager | |
| 8,689,621 | B2 | 4/2014 | Godager | |
| 8,826,980 | B2 | 9/2014 | Neer | |
| 8,833,469 | B2 | 9/2014 | Purkis | |
| 2004/0055746 | A1* | 3/2004 | Ross | B23K 3/0623 166/250.15 |
| 2004/0239521 | A1* | 12/2004 | Zierolf | G01V 3/30 340/854.1 |
| 2005/0241824 | A1* | 11/2005 | Burris, II | E21B 23/00 166/255.1 |
| 2005/0269083 | A1* | 12/2005 | Burris, II | E21B 23/00 166/255.2 |
| 2006/0250243 | A1 | 11/2006 | Masino et al. | |
| 2007/0272411 | A1* | 11/2007 | Lopez De Cardenas | E21B 34/06 166/305.1 |
| 2009/0034368 | A1* | 2/2009 | Johnson | E21B 47/14 367/83 |
| 2011/0056692 | A1* | 3/2011 | Lopez de Cardenas | E21B 34/06 166/305.1 |
| 2011/0186290 | A1 | 8/2011 | Roddy et al. | |
| 2013/0062055 | A1* | 3/2013 | Tolman | E21B 23/00 166/250.01 |
| 2013/0168081 | A1* | 7/2013 | Yang | E21B 47/12 166/247 |
| 2013/0186645 | A1* | 7/2013 | Hall | E21B 23/00 166/382 |
| 2013/0192823 | A1 | 8/2013 | Barrilleaux et al. | |
| 2013/0248172 | A1 | 9/2013 | Angeles Boza et al. | |
| 2013/0255963 | A1 | 10/2013 | Guerrerro et al. | |
| 2014/0152659 | A1 | 6/2014 | Davidson et al. | |
| 2014/0266769 | A1 | 9/2014 | van Zelm | |
| 2014/0327552 | A1 | 11/2014 | Filas et al. | |
| 2014/0352955 | A1 | 12/2014 | Tubel et al. | |
| 2015/0003202 | A1 | 1/2015 | Palmer et al. | |
| 2015/0009040 | A1 | 1/2015 | Bowles et al. | |
| 2015/0027687 | A1 | 1/2015 | Tubel | |

FOREIGN PATENT DOCUMENTS

| | | | |
|---|---|---|---|
| WO | WO 2013/112273 | A2 | 8/2013 |
| WO | WO 2014/018010 | A1 | 1/2014 |
| WO | WO 2014/049360 | A2 | 4/2014 |
| WO | WO 2014/134741 | A1 | 9/2014 |

* cited by examiner

DISCRETE WELLBORE DEVICES, HYDROCARBON WELLS INCLUDING A DOWNHOLE COMMUNICATION NETWORK AND THE DISCRETE WELLBORE DEVICES AND SYSTEMS AND METHODS INCLUDING THE SAME

CROSS-REFERENCE TO RELATED APPLICATION

This application claims the benefit of U.S. Provisional Patent Application 62/049,513, filed Sep. 12, 2014, entitled "Discrete Wellbore Devices, Hydrocarbon Wells Including A Downhole Communication Network And The Discrete Wellbore Devices and Systems and Methods Including The Same," the entirety of which is incorporated by reference herein.

FIELD OF THE DISCLOSURE

The present disclosure is directed to discrete wellbore devices, to hydrocarbon wells that include both a downhole communication network and the discrete wellbore devices, as well as to systems and methods that include the downhole communication network and/or the discrete wellbore device.

BACKGROUND OF THE DISCLOSURE

An autonomous wellbore tool may be utilized to perform one or more downhole operations within a wellbore conduit that may be defined by a wellbore tubular and/or that may extend within a subterranean formation. Generally, the autonomous wellbore tool is pre-programmed within a surface region, such as by direct, or physical, attachment to a programming device, such as a computer. Subsequently, the autonomous wellbore tool may be released into the wellbore conduit and may be conveyed autonomously therein. A built-in controller, which forms a portion of the autonomous wellbore tool, may retain program information from the pre-programming process and may utilize this program information to control the operation of the autonomous wellbore tool. This may include controlling actuation of the autonomous wellbore tool when one or more actuation criteria are met.

With traditional autonomous wellbore tools, an operator cannot modify and/or change programming once the autonomous wellbore tool has been released within the wellbore conduit. In addition, the operator also may not receive any form of direct communication to indicate that the autonomous wellbore tool has executed the downhole operation. Thus, there exists a need for discrete wellbore devices that are configured to communicate wirelessly, for hydrocarbon wells including a wireless communication network and the discrete wellbore devices, and for systems and methods including the same.

SUMMARY OF THE DISCLOSURE

Discrete wellbore devices, hydrocarbon wells including a downhole communication network and the discrete wellbore devices, and systems and methods including the same are disclosed herein. The discrete wellbore devices include a wellbore tool and a communication device. The wellbore tool is configured to perform a downhole operation within a wellbore conduit that is defined by a wellbore tubular of the hydrocarbon well. The communication device is operatively coupled for movement with the wellbore tool within the wellbore conduit. The communication device is configured to communicate, via a wireless communication signal, with a downhole communication network that extends along the wellbore tubular.

The hydrocarbon wells include a wellbore that extends within a subterranean formation. The hydrocarbon wells further include the wellbore tubular, and the wellbore tubular extends within the wellbore. The hydrocarbon wells also include the downhole communication network, and the downhole communication network is configured to transfer a data signal along the wellbore conduit and/or to a surface region. The hydrocarbon wells further include the discrete wellbore device, and the discrete wellbore device is located within a downhole portion of the wellbore conduit.

The methods may include actively and/or passively detecting a location of the discrete wellbore device within the wellbore conduit. These methods include conveying the discrete wellbore device within the wellbore conduit and wirelessly detecting proximity of the discrete wellbore device to a node of the downhole communication network. These methods further include generating a location indication signal with the node responsive to detecting proximity of the discrete wellbore device to the node. These methods also include transferring the location indication signal to the surface region with the downhole communication network.

The methods additionally or alternatively may include wireless communication between the discrete wellbore device and the downhole communication network. The communication may include transmitting data signals from the discrete wellbore device. The communication may include transmitting commands and/or programming to the discrete wellbore device. These methods include conveying the discrete wellbore device within the wellbore conduit and transmitting the wireless communication signal between the discrete wellbore device and a given node of the downhole communication network and/or another discrete wellbore device within the wellbore.

DETAILED DESCRIPTION AND BEST MODE OF THE DISCLOSURE

Figure 1:
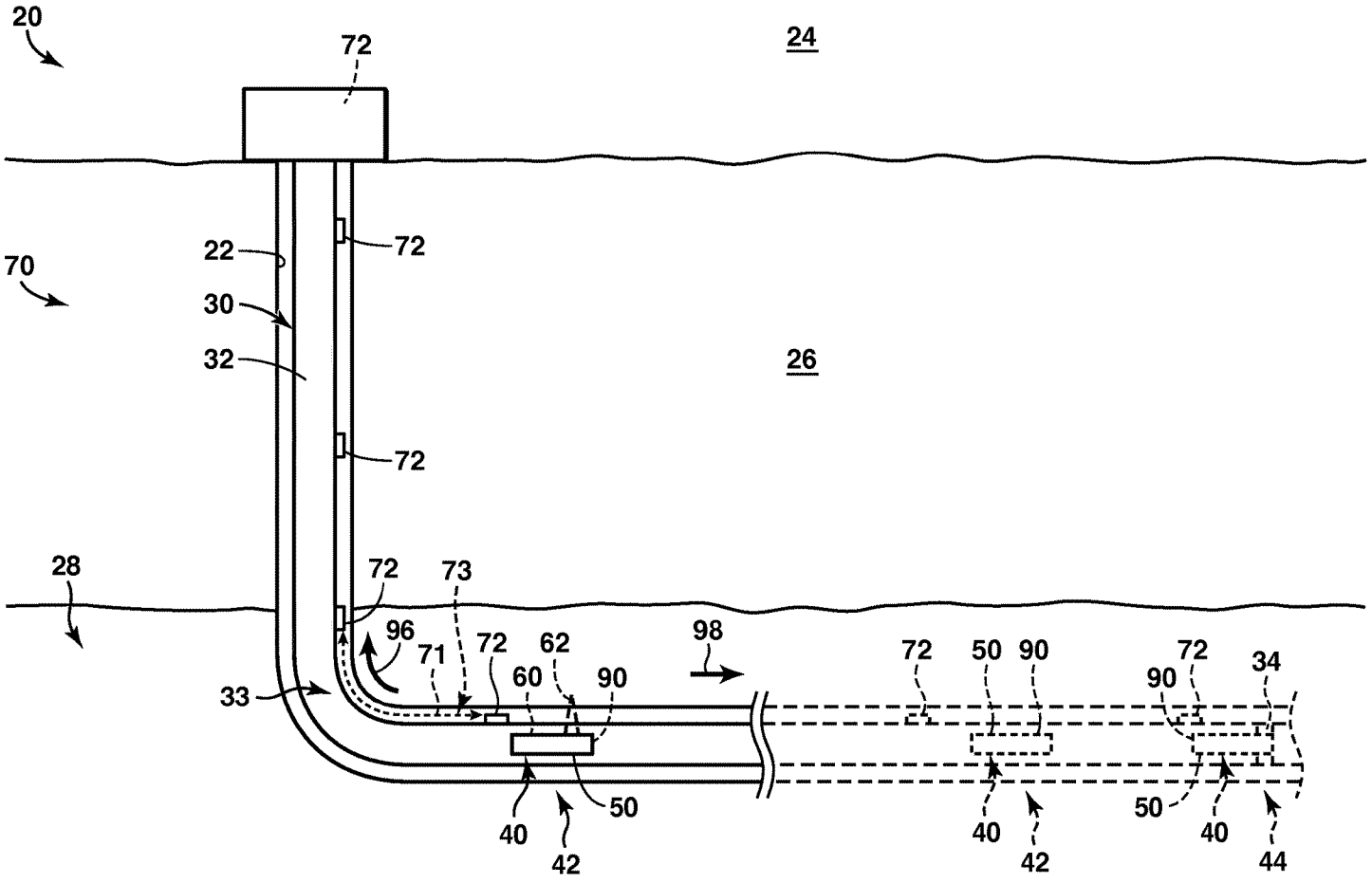
FIG. 1 is a schematic representation of a hydrocarbon well that may include and/or utilize the systems, discrete wellbore devices, and methods according to the present disclosure.

FIGS. 1-4 provide examples of discrete wellbore devices 40 according to the present disclosure, of hydrocarbon wells 20 and/or wellbore conduits 32 that include, contain, and/or utilize discrete wellbore devices 40, of methods 100, according to the present disclosure, of determining a location of discrete wellbore devices 40 within wellbore conduit 32, and/or of methods 200, according to the present disclosure, of operating discrete wellbore devices 40. Elements that serve a similar, or at least substantially similar, purpose are labeled with like numbers in each of FIGS. 1-4, and these elements may not be discussed in detail herein with reference to each of FIGS. 1-4. Similarly, all elements may not be labeled in each of FIGS. 1-4, but reference numerals associated therewith may be utilized herein for consistency. Elements, components, and/or features that are discussed herein with reference to one or more of FIGS. 1-4 may be included in and/or utilized with any of FIGS. 1-4 without departing from the scope of the present disclosure.

In general, elements that are likely to be included are illustrated in solid lines, while elements that are optional are illustrated in dashed lines. However, elements that are shown in solid lines may not be essential. Thus, an element shown in solid lines may be omitted without departing from the scope of the present disclosure.

Figure 2:
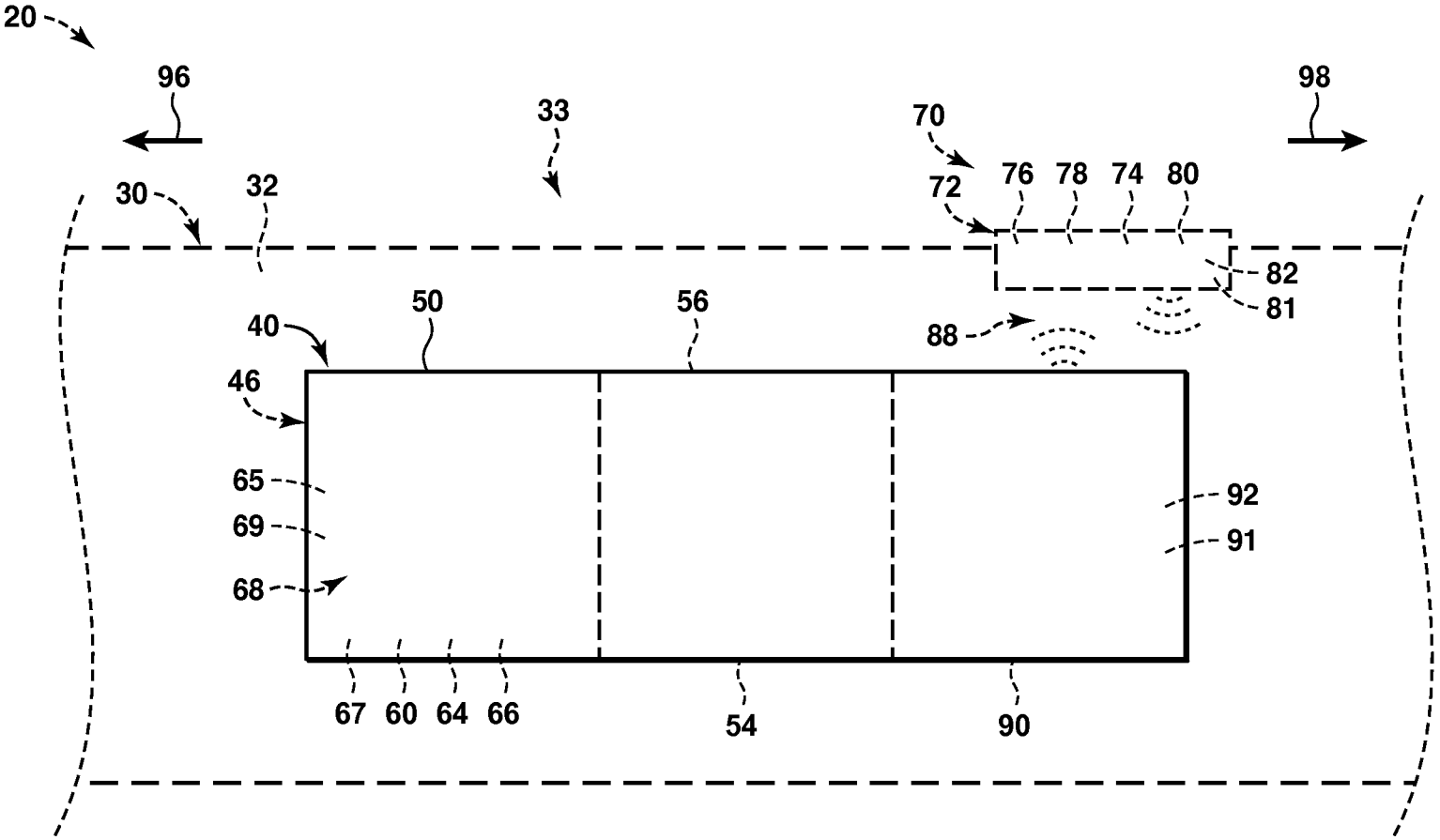
FIG. 2 is a schematic cross-sectional view of a discrete wellbore device, according to the present disclosure, that may be located within a wellbore conduit of a hydrocarbon well.

FIG. 1 is a schematic representation of a hydrocarbon well 20 that may include and/or utilize the systems and methods according to the present disclosure, while FIG. 2 is a schematic cross-sectional view of a discrete wellbore device 40, according to the present disclosure, that may be located within a wellbore conduit 32 of hydrocarbon well 20. As illustrated in FIG. 1, hydrocarbon well 20 includes a wellbore 22 that may extend within a subterranean formation 28 that may be present within a subsurface region 26. Additionally or alternatively, wellbore 22 may extend between a surface region 24 and subterranean formation 28. A wellbore tubular 30 extends within wellbore 22. The wellbore tubular defines wellbore conduit 32. Wellbore tubular 30 may include any suitable structure that may extend within wellbore 22 and/or that may define wellbore conduit 32. As examples, wellbore tubular 30 may include and/or be a casing string and/or tubing.

Hydrocarbon well 20 further includes a downhole communication network 70. Downhole communication network 70 includes a plurality of nodes 72 and is configured to transfer a data signal 71 along wellbore conduit 32, from surface region 24, to subsurface region 26, from surface region 24 to subterranean formation 28, and/or from subterranean formation 28 to surface region 24. Hydrocarbon well 20 also includes a discrete wellbore device 40, and the discrete wellbore device is located within a subterranean portion 33 of the wellbore conduit (i.e., a portion of wellbore conduit 32 that extends within subsurface region 26 and/or within subterranean formation 28).

As illustrated in FIG. 2, discrete wellbore device 40 includes a wellbore tool 50 and may include a control structure 54 and/or a communication device 90. Wellbore tool 50 is configured to perform a downhole operation within wellbore conduit 32. Communication device 90 may be operatively coupled and/or attached to wellbore tool 50 and may be configured for movement with wellbore tool 50 within the wellbore conduit. In addition, communication device 90 may be configured to communicate with downhole communication network 70 via a wireless communication signal 88 while discrete wellbore device 40 is being conveyed within the wellbore conduit.

Discrete wellbore device 40 may include and/or be an autonomous wellbore device that may be configured for autonomous, self-regulated, and/or self-controlled operation within wellbore conduit 32. Alternatively, discrete wellbore device 40 may be a remotely controlled wellbore device, and wireless communication signal 88 may be utilized to control at least a portion of the operation of the discrete wellbore device. Regardless of the exact configuration, discrete wellbore device 40 may be configured to be conveyed within wellbore conduit 32 in an untethered manner Stated another way, discrete wellbore device 40 may be uncoupled, or unattached, to surface region 24 while being conveyed within wellbore conduit 32 and/or when located within subterranean portion 33 of wellbore conduit 32. Stated yet another way, discrete wellbore device 40 may be free from physical contact, or connection, with surface region 24 and/or with a structure that is present within surface region 24 while being conveyed within wellbore conduit 32. Thus, discrete wellbore device 40 also may be referred to herein as an autonomous wellbore device 40, a disconnected wellbore device 40, a detached wellbore device 40, a free-flowing wellbore device 40, an independent wellbore device 40, a separate wellbore device 40, and/or a fluid-conveyed wellbore device 40.

Any structure(s) that form a portion of discrete wellbore device 40 may be operatively attached to one another and may be sized to be deployed within wellbore conduit 32 as a single, independent, and/or discrete, unit. Stated another way, discrete wellbore device 40 may include and/or be a unitary structure. Stated yet another way, discrete wellbore device 40 may include a housing 46 that may contain and/or house the structure(s) that form wellbore device 40. Examples of these structures include wellbore tool 50, communication device 90, control structure 54, and/or components thereof.

Wellbore tool 50 may include any suitable structure that may be adapted, configured, designed, and/or constructed to perform the downhole operation within wellbore conduit 32. As an example, wellbore tool 50 may include and/or be a perforation device 60 that is configured to form one or more perforations 62 (as illustrated in FIG. 1) within wellbore tubular 30. Under these conditions, the downhole operation may include perforation of the wellbore tubular.

As additional examples, wellbore tool 50 may include and/or be a plug 64 and/or a packer 66. Under these conditions, the downhole operation may include at least partial, or even complete, occlusion of the wellbore conduit by the plug and/or by the packer.

As yet another example, wellbore tool 50 may include and/or define an enclosed volume 68. The enclosed volume may contain a chemical 69, and the downhole operation may include release of the chemical into the wellbore conduit. Additionally or alternatively, the enclosed volume may contain a diversion agent 65, and the downhole operation may include release of the diversion agent into the wellbore conduit. Examples of diversion agent 65 include any suitable ball sealer, supplemental sealing material that is configured to seal a perforation within wellbore tubular 30, polylactic acid flakes, a chemical diversion agent, a self-degrading diversion agent, and/or a viscous gel.

As another example, wellbore tool 50 may include and/or be an orientation-regulating structure 67. The orientation-regulating structure may be configured to be conveyed with the wellbore tool within the wellbore conduit and to regulate a cross-sectional orientation of the wellbore tool within the wellbore conduit while the discrete wellbore device is being conveyed within the wellbore conduit. Under these conditions, the downhole operation may include regulation of the cross-sectional orientation of the wellbore tool.

Control structure 54, when present, may include any suitable structure that may be adapted, configured, designed, and/or constructed to be conveyed with the wellbore tool within the wellbore conduit. The control structure also may be adapted, configured, designed, constructed, and/or programmed to control the operation of at least a portion of the discrete wellbore device. This may include independent, autonomous, and/or discrete control of the discrete wellbore device.

As an example, control structure 54 may be programmed to determine that an actuation criterion has been satisfied. Responsive to the actuation criterion being satisfied, the control structure may provide an actuation signal to wellbore tool 50, and the wellbore tool may perform the downhole operation responsive to receipt of the actuation signal. The control structure then may be programmed to automatically generate (or control communication device 90 to generate) a wireless confirmation signal after performing the downhole operation. The wireless confirmation signal may confirm that the downhole operation was performed and may be conveyed to surface region 24 by downhole communication network 70.

The actuation criterion may include any suitable criterion. As an example, the actuation criterion may include receipt of a predetermined wireless communication signal from downhole communication network 70. As another example, discrete wellbore device 40 further may include a detector 56. Detector 56 may be adapted, configured, designed, and/or constructed to detect a downhole parameter and/or a parameter of the discrete wellbore device. Under these conditions, discrete wellbore device 40 may be configured to generate wireless communication signal 88, and the wireless communication signal may include, or be based upon, the downhole parameter and/or the parameter of the discrete wellbore device. Additionally or alternatively, the actuation criterion may include detecting the downhole parameter and/or the parameter of the discrete wellbore device, such as by determining that the downhole parameter and/or the parameter of the discrete wellbore device is outside a threshold, or predetermined, parameter range.

Communication device 90, when present, may include any suitable structure that is adapted, configured, designed, constructed, and/or programmed to communicate with downhole communication network 70 via wireless communication signal 88. As an example, communication device 90 may include a wireless device transmitter 91. The wireless device transmitter may be configured to generate wireless communication signal 88 and/or to convey the wireless communication signal to downhole communication network 70. As another example, communication device 90 additionally or alternatively may include a wireless device receiver 92. The wireless device receiver may be configured to receive the wireless communication signal from the downhole communication network and/or from another discrete wellbore device.

Wireless communication signal 88 may include and/or be any suitable wireless signal. As examples, the wireless communication signal may be an acoustic wave, a high frequency acoustic wave, a low frequency acoustic wave, a radio wave, an electromagnetic wave, light, an electric field, and/or a magnetic field.

During operation of hydrocarbon well 20, discrete wellbore device 40 may be located and/or placed within wellbore conduit 32 and subsequently may be conveyed within the wellbore conduit such that the discrete wellbore device is located within subterranean portion 33 of the wellbore conduit. This may include the discrete wellbore device being conveyed in an uphole direction 96 (i.e., toward surface region 24 and/or away from subterranean formation 28) and/or in a downhole direction 98 (i.e., toward subterranean formation 28 and/or away from surface region 24), as illustrated in FIG. 1.

As illustrated in dashed lines in FIG. 1, discrete wellbore device 40 may include and/or define a mobile conformation 42 and a seated conformation 44. Under these conditions, the downhole operation may include transitioning the discrete wellbore device from the mobile conformation to the seated conformation. When the discrete wellbore device is in mobile conformation 42, the discrete wellbore device may be adapted, configured, and/or sized to translate and/or otherwise be conveyed within wellbore conduit 32. When the discrete wellbore device is in seated conformation 44, the discrete wellbore device may be adapted, configured, and/or sized to be retained, or seated, at a target location within wellbore conduit 32. As an example, a fracture sleeve 34 may extend within (or define a portion of) wellbore conduit 32. When in the mobile conformation, the discrete wellbore device may be free to be conveyed past the fracture sleeve within the wellbore conduit. In contrast, and when in the seated conformation, the discrete wellbore device may be (or be sized to be) retained on the fracture sleeve.

While discrete wellbore device 40 is located within the wellbore conduit and/or within subterranean portion 33 thereof, the discrete wellbore device may wirelessly communicate with downhole communication network 70 and/or with one or more nodes 72 thereof. This wireless communication may be passive wireless communication or active wireless communication and may be utilized to permit and/or facilitate communication between discrete wellbore device 40 and surface region 24, to permit and/or facilitate communication between two or more discrete wellbore devices 40, to provide information about discrete wellbore device 40 to surface region 24, and/or to permit wireless control of the operation of discrete wellbore device 40 by an operator who may be located within surface region 24.

As used herein, the phrase "passive wireless communication" may be utilized to indicate that downhole communication network 70 is configured to passively detect and/or determine one or more properties of discrete wellbore device 40 without discrete wellbore device 40 including (or being required to include) an electronically controlled structure that is configured to emit a signal (wireless or otherwise) that is indicative of the one or more properties. As an example, downhole communication network 70 and/or one or more nodes 72 thereof may include a sensor 80 (as illustrated in FIG. 2) that may be configured to wirelessly detect proximity of discrete wellbore device 40 to a given node 72.

Under these conditions, sensor 80 may detect a parameter that is indicative of proximity of discrete wellbore device 40 to the given node 72. Examples of sensor 80 include an acoustic sensor that is configured to detect a sound that is indicative of proximity of discrete wellbore device 40 to the given node, a pressure sensor that is configured to detect a pressure (or pressure change) that is indicative of proximity of the discrete wellbore device to the given node, a vibration sensor that is configured to detect a vibration that is indicative of proximity of the discrete wellbore device to the given node, and/or an electric field sensor that is configured to detect an electric field that is indicative of proximity of the discrete wellbore device to the given node. Additional examples of sensor 80 include a magnetic field sensor that is configured to detect a magnetic field that is indicative of proximity of the discrete wellbore device to the given node, an electromagnetic sensor that is configured to detect an electromagnetic field that is indicative of proximity of the discrete wellbore device to the given node, a radio sensor that is configured to detect a radio wave signal that is indicative of proximity of the discrete wellbore device to the given node, and/or an optical sensor that is configured to detect an optical signal that is indicative of proximity of the discrete wellbore device to the given node.

As used herein, the phrase "active wireless communication" may be utilized to indicate electronically controlled wireless communication between discrete wellbore device 40 and downhole communication network 70. This active wireless communication may include one-way wireless communication or two-way wireless communication.

With one-way wireless communication, one of discrete wellbore device 40 and downhole communication network 70 may be configured to generate a wireless communication signal 88, and the other of discrete wellbore device 40 and downhole communication network 70 may be configured to receive the wireless communication signal. As an example, node 72 may include a wireless node transmitter 81 that is configured to generate wireless communication signal 88, and discrete wellbore device 40 may include wireless device receiver 92 that is configured to receive the wireless communication signal. As another example, discrete wellbore device 40 may include wireless device transmitter 91 that is configured to generate wireless communication signal 88, and node 72 may include a wireless node receiver 82 that is configured to receive the wireless communication signal.

With two-way wireless communication, discrete wellbore device 40 and downhole communication network 70 each may include respective wireless transmitters and respective wireless receivers. As an example, discrete wellbore device 40 may include both wireless device transmitter 91 and wireless device receiver 92. In addition, node 72 may include both wireless node transmitter 81 and wireless node receiver 82.

Returning to FIG. 1, the active and/or passive wireless communication between downhole communication network 70 and discrete wellbore device 40 may be utilized in a variety of ways. As an example, each node 72 may (passively or actively) detect proximity of discrete wellbore device 40 thereto and/or flow of discrete wellbore device 40 therepast. The node then may convey this information, via data signal 71, along wellbore conduit 32 and/or to surface region 24. Thus, downhole communication network 70 may be utilized to provide an operator of hydrocarbon well 20 with feedback information regarding a (at least approximate) location of discrete wellbore device 40 within wellbore conduit 32 as the discrete wellbore device is conveyed within the wellbore conduit.

As another example, downhole communication network 70 and/or nodes 72 thereof may be adapted, configured, and/or programmed to generate wireless data signal 88 (as illustrated in FIG. 2) that is indicative of a location and/or a depth of individual nodes 72 within subsurface region 26. This wireless data signal may be received by discrete wellbore device 40, and the discrete wellbore device may be adapted, configured, and/or programmed to perform one or more actions based upon the received location and/or depth.

As yet another example, discrete wellbore device 40 may be configured to perform the downhole operation within wellbore conduit 32. Under these conditions, it may be desirable to arm discrete wellbore device 40 once the discrete wellbore device reaches a threshold arming depth within subsurface region 26, and downhole communication network 70 may be configured to transmit a wireless arming signal to discrete wellbore device 40 responsive to the discrete wellbore device reaching the threshold arming depth. Downhole communication network 70 also may be configured to transmit a wireless actuation signal to discrete wellbore device 40 once the discrete wellbore device reaches a target region of the wellbore conduit. Responsive to receipt of the wireless actuation signal, discrete wellbore device 40 may perform the downhole operation within wellbore conduit 32. Downhole communication network 70 (or a node 72 thereof that is proximate perforation 62) may be configured to detect and/or determine that the downhole operation was performed (such as via detector 80 of FIG. 2) and may transmit a successful actuation signal via downhole communication network 70 and/or to surface region 24. Additionally or alternatively, downhole communication network 70 may be configured to detect and/or determine that discrete wellbore device 40 was unsuccessfully actuated (such as via detector 80) and may transmit an unsuccessful actuation signal via downhole communication network 70 and/or to surface region 24.

As another example, downhole communication network 70 may be configured to transmit a wireless query signal to discrete wellbore device 40. Responsive to receipt of the wireless query signal, discrete wellbore device 40 may be configured to generate and/or transmit a wireless status signal to downhole communication network 70. The wireless status signal may be received by downhole communication network 70 and/or a node 72 thereof. The wireless status signal may include information regarding a status of discrete wellbore device 40, an operational state of discrete wellbore device 40, a depth of discrete wellbore device 40 within the subterranean formation, a velocity of discrete wellbore device 40 within wellbore conduit 32, a battery power level of discrete wellbore device 40, a fault status of discrete wellbore device 40, and/or an arming status of discrete wellbore device 40. Downhole communication network 70 then may be configured to convey the information obtained from discrete wellbore device 40 along wellbore conduit 32 and/or to surface region 24 via data signal 71.

As yet another example, communication between discrete wellbore device 40 and downhole communication network 70 may be utilized to program, re-program, and/or control discrete wellbore device 40 in real-time, while discrete wellbore device 40 is present within wellbore conduit 32, and/or while discrete wellbore device 40 is being conveyed in the wellbore conduit. This may include transferring any suitable signal and/or command from surface region 24 to downhole communication network 70 as data signal 71, transferring the signal and/or command along wellbore conduit 32 via downhole communication network 70 and/or data signal 71 thereof, and/or wirelessly transmitting the signal and/or command from downhole communication network 70 (or a given node 72 thereof) to discrete wellbore device 40 (such as via wireless communication signal 88 of FIG. 2) as a wireless control signal.

As illustrated in dashed lines in FIG. 1, a plurality of discrete wellbore devices 40 may be located and/or present within wellbore conduit 32. When wellbore conduit 32 includes and/or contains the plurality of discrete wellbore devices 40, the discrete wellbore devices may be adapted, configured, and/or programmed to communicate with one another. For example, a first discrete wellbore device 40 may transmit a wireless communication signal directly to a second discrete wellbore device 40, with the second discrete wellbore device 40 receiving and/or acting upon information contained within the wireless communication signal. As another example, the first discrete wellbore device may transmit the wireless communication signal to downhole communication network 70, and downhole communication network 70 may convey the wireless communication signal to the second discrete wellbore device. This communication may permit the second discrete wellbore device to be programmed and/or re-programmed based upon information received from the first discrete wellbore device.

Downhole communication network 70 include any suitable structure that may be configured for wireless communication with discrete wellbore device 40 via wireless communication signals 88 (as illustrated in FIG. 2) and/or that may be configured to convey data signal 71 along wellbore conduit 32, to surface region 24 from subsurface region 26, and/or to subsurface region 26 from surface region 24. As an example, a plurality of nodes 72 may be spaced apart along wellbore conduit 32 (as illustrated in FIG. 1), and downhole communication network 70 may be configured to sequentially transmit data signal 71 among the plurality of nodes 72 and/or along wellbore conduit 32.

Transfer of data signal 71 between adjacent nodes 72 may be performed wirelessly, in which case downhole communication network 70 may be referred to herein as and/or may be a wireless downhole communication network 70. Under these conditions, data signal 71 may include and/or be an acoustic wave, a high frequency acoustic wave, a low frequency acoustic wave, a radio wave, an electromagnetic wave, light, an electric field, and/or a magnetic field. Additionally or alternatively, transfer of data signal 71 between adjacent nodes 72 may be performed in a wired fashion and/or via a data cable 73, in which case downhole communication network 70 may be referred to herein as and/or may be a wired downhole communication network 70. Under these conditions, data signal 71 may include and/or be an electrical signal.

As illustrated in FIG. 2, a given node 72 may include a data transmitter 76 that may be configured to generate the data signal and/or to provide the data signal to at least one other node 72. In addition, the given node 72 also may include a data receiver 78 that may be configured to receive the data signal from at least one other node 72. In general, the other nodes 72 may be adjacent to the given node 72, with one of the other nodes being located in uphole direction 96 from the given node and another of the other nodes being located in downhole direction 98 from the given node.

As discussed, nodes 72 also may include one or more sensors 80. Sensors 80 may be configured to detect a downhole parameter. Examples of the downhole parameter include a downhole temperature, a downhole pressure, a downhole fluid velocity, and/or a downhole fluid flow rate. Additional examples of the downhole parameter are discussed herein with reference to the parameters that are indicative of proximity of discrete wellbore device 40 to nodes 72 and/or that are indicative of the discrete wellbore device flowing past nodes 72 within wellbore conduit 32.

As also illustrated in FIG. 2, nodes 72 further may include a power source 74. Power source 74 may be configured to provide electrical power to one or more nodes 72. An example of power source 74 is a battery, which may be a rechargeable battery.

FIG. 2 schematically illustrates a node 72 as extending both inside and outside wellbore conduit 32, and it is within the scope of the present disclosure that nodes 72 may be located within hydrocarbon well 20 in any suitable manner. As an example, one or more nodes 72 of downhole communication network 70 may be operatively attached to an external surface of wellbore tubular 30. As another example, one or more nodes 72 of downhole communication network 70 may be operatively attached to an internal surface of wellbore tubular 30. As yet another example, one or more nodes 72 of downhole communication network 70 may extend through wellbore tubular 30, within wellbore tubular 30, and/or between the inner surface of the wellbore tubular and the outer surface of the wellbore tubular.

Figure 3:
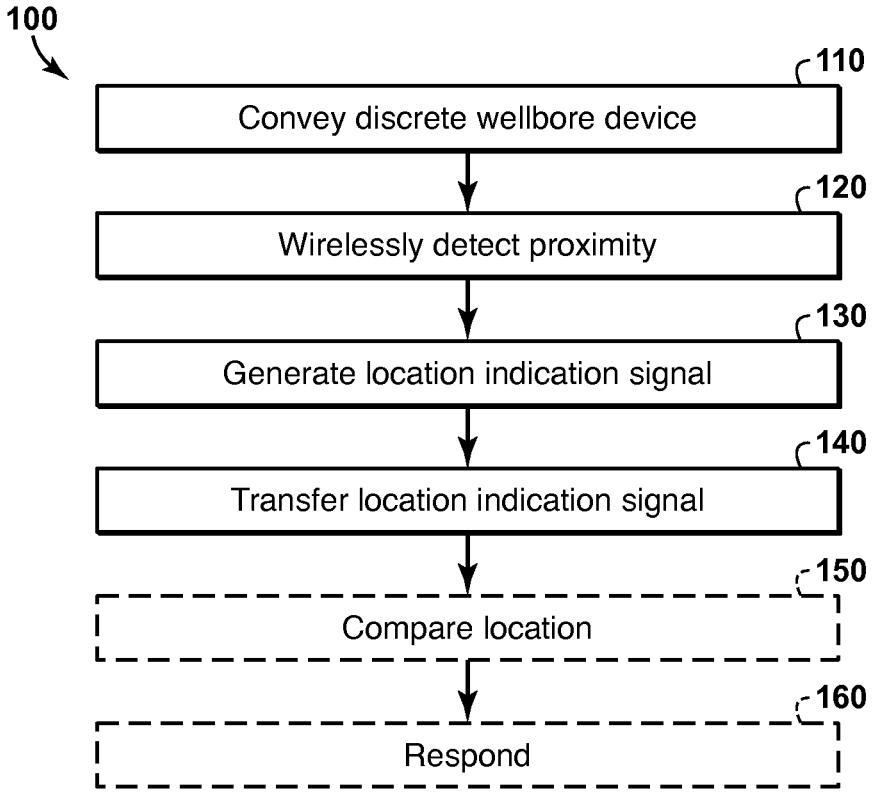
FIG. 3 is a flowchart depicting methods, according to the present disclosure, of determining a location of a discrete wellbore device within a wellbore conduit.

FIG. 3 is a flowchart depicting methods 100, according to the present disclosure, of determining a location of a discrete wellbore device within a wellbore conduit. Methods 100 include conveying the discrete wellbore device within the wellbore conduit at 110 and wirelessly detecting proximity of the discrete wellbore device to a node of a downhole communication network at 120. Methods 100 further include generating a location indication signal at 130 and transferring the location indication signal at 140. Methods 100 also may include comparing a calculated location of the discrete wellbore device to an actual location of the discrete wellbore device at 150 and/or responding to a location difference at 160.

Conveying the discrete wellbore device within the wellbore conduit at 110 may include translating the discrete wellbore device within the wellbore conduit in any suitable manner. As an example, the conveying at 110 may include translating the discrete wellbore device along at least a portion of a length of the wellbore conduit. As another example, the conveying at 110 may include conveying the discrete wellbore device from a surface region and into and/or within a subterranean formation. As another example, the conveying at 110 may include providing a fluid stream to the wellbore conduit and flowing the discrete wellbore device in, or within, the fluid stream. As yet another example, the conveying at 110 may include conveying under the influence of gravity.

Wirelessly detecting proximity of the discrete wellbore device to the node of the downhole communication network at 120 may include wirelessly detecting in any suitable manner. The downhole communication network may include a plurality of nodes that extends along the wellbore conduit, and the wirelessly detecting at 120 may include wirelessly detecting proximity of the discrete wellbore device to a specific, given, or individual, node.

The wirelessly detecting at 120 may be passive or active. When the wirelessly detecting is passive, the downhole communication network (or the node) may be configured to detect proximity of the discrete wellbore device thereto without the discrete wellbore device including (or being required to include) an electronically controlled structure that is configured to emit a wireless communication signal. As an example, the node may include a sensor that is configured to detect proximity of the discrete wellbore device thereto. Examples of the sensor are disclosed herein.

When the wirelessly detecting at 120 is active, the discrete wellbore device may include a wireless transmitter that is configured to generate the wireless communication signal. Under these conditions, the wirelessly detecting at 120 may include wirelessly detecting the wireless communication signal. Examples of the wireless communication signal are disclosed herein.

It is within the scope of the present disclosure that the wireless communication signal may be selected such that the wireless communication signal is only conveyed over a (relatively) short transmission distance within the wellbore conduit, such as a transmission distance of less than 5 meters, less than 2.5 meters, or less than 1 meter. Additional examples of the transmission distance are disclosed herein. Under these conditions, the plurality of nodes of the downhole communication network may be spaced apart a greater distance than the transmission distance of the wireless communication signal. As such, only a single node may detect the wireless communication signal at a given point in time and/or the single node may only detect the wireless communication signal when the discrete wellbore device is less than the transmission distance away from the given node.

Alternatively, the wireless communication signal may be selected such that the wireless communication signal is conveyed over a (relatively) larger transmission distance within the wellbore conduit, such as a transmission distance that may be greater than the spacing between nodes, or a node-to-node separation distance, of the downhole communication network. Under these conditions, two or more nodes of the downhole communication network may detect the wireless communication signal at a given point in time, and a signal strength of the wireless communication signal that is received by the two or more nodes may be utilized to determine, estimate, or calculate, the location of the discrete wellbore device within the wellbore conduit and/or proximity of the discrete wellbore device to a given node of the downhole communication network.

Examples of the node-to-node separation distance include node-to-node separation distances of at least 5 meters (m), at least 7.5 m, at least 10 m, at least 12.5 m, at least 15 m, at least 20 m, at least 25 m, at least 30 m, at least 40 m, at least 50 m, at least 75 m, or at least 100 m. Additionally or alternatively, the node-to-node separation distance may be less than 300 m, less than 200 m, less than 100 m, less than 50 m, less than 45 m, less than 40 m, less than 35 m, less than 30 m, less than 25 m, less than 20 m, less than 15 m, or less than 10 m.

The node-to-node separation distance also may be described relative to a length of the wellbore conduit. As examples, the node-to-node separation distance may be at least 0.1% of the length, at least 0.25% of the length, at least 0.5% of the length, at least 1% of the length, or at least 2% of the length. Additionally or alternatively, the node-to-node separation distance also may be less than 25% of the length, less than 20% of the length, less than 15% of the length, less than 10% of the length, less than 5% of the length, less than 2.5% of the length, or less than 1% of the length.

The discrete wellbore device also may be configured to generate a wireless location indication signal. The wireless location indication signal may be indicative of a calculated location of the discrete wellbore device within the wellbore conduit, with this calculated location being determined by the discrete wellbore device (or a control structure thereof). Under these conditions, the wirelessly detecting at 120 additionally or alternatively may include detecting the wireless location indication signal.

Generating the location indication signal at 130 may include generating the location indication signal with the node responsive to the wirelessly detecting at 120. As an example, the node may include a data transmitter that is configured to generate the location indication signal. Examples of the data transmitter and/or of the location indication signal are disclosed herein.

Transferring the location indication signal at 140 may include transferring the location indication signal from the node to the surface region with, via, and/or utilizing the downhole communication network. As an example, the transferring at 140 may include sequentially transferring the location indication signal along the wellbore conduit and to the surface region via the plurality of nodes. As another example, the transferring at 140 may include propagating the location indication signal from one node to the next within the downhole communication network. The propagation may be wired and/or wireless, as discussed herein.

Comparing the calculated location of the discrete wellbore device to the actual location of the discrete wellbore device at 150 may include comparing in any suitable manner. As an example, and as discussed, the wirelessly detecting at 120 may include wirelessly detecting a location indication signal that may be generated by the discrete wellbore device. As also discussed, this location indication signal may include the calculated location of the discrete wellbore device, as calculated by the discrete wellbore device. As another example, a location of each node of the downhole communication network may be (at least approximately) known and/or tabulated. As such, the actual location of the discrete wellbore device may be determined based upon knowledge of which node of the downhole communication network is receiving the location indication signal from the discrete wellbore device.

Responding to the location difference at 160 may include responding in any suitable manner and/or based upon any suitable criterion. As an example, the responding at 160 may include responding if the calculated location differs from the actual location by more than a location difference threshold. As another example, the responding at 160 may include re-programming the discrete wellbore device, such as based upon a difference between the calculated location and the actual location. As yet another example, the responding at 160 may include aborting the downhole operation. As another example, the responding at 160 may include calibrating the discrete wellbore device such that the calculated location corresponds to, is equal to, or is at least substantially equal to the actual location.

Figure 4:
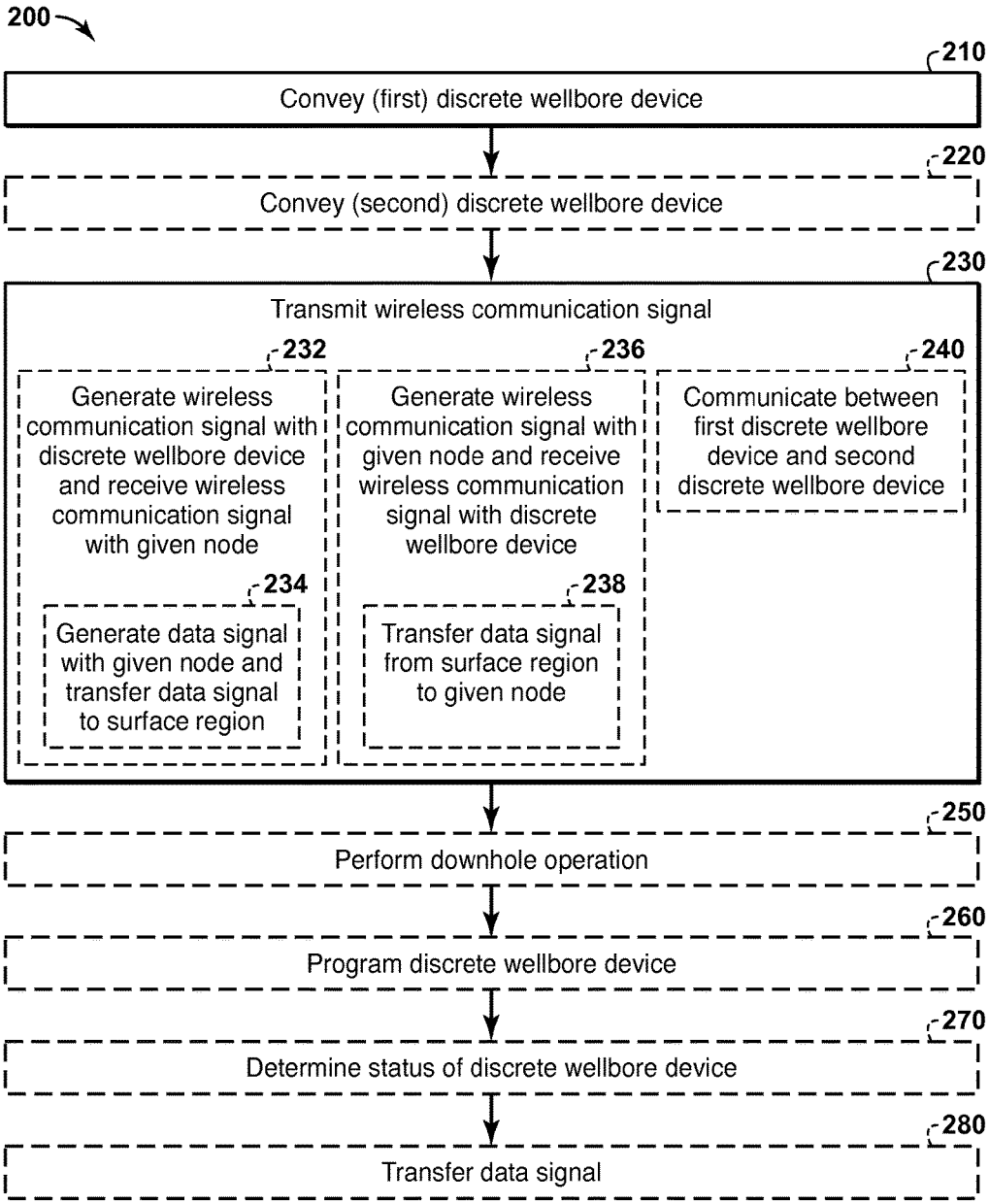
FIG. 4 is a flowchart depicting methods, according to the present disclosure, of operating a discrete wellbore device.

FIG. 4 is a flowchart depicting methods 200, according to the present disclosure, of operating a discrete wellbore device. The methods may be at least partially performed within a wellbore conduit that may be defined by a wellbore tubular that extends within a subterranean formation. A downhole communication network that includes a plurality of nodes may extend along the wellbore conduit and may be configured to transfer a data signal along the wellbore conduit and/or to and/or from a surface region.

Methods 200 include conveying a (first) discrete wellbore device within the wellbore conduit at 210 and may include conveying a second discrete wellbore device within the wellbore conduit at 220. Methods 200 further include transmitting a wireless communication signal at 230 and may include performing a downhole operation at 250 and/or programming the discrete wellbore device at 260. Methods 200 further may include determining a status of the discrete wellbore device at 270 and/or transferring a data signal at 280.

Conveying the (first) discrete wellbore device within the wellbore conduit at 210 may include conveying the (first) discrete wellbore device in any suitable manner. Examples of the conveying at 210 are disclosed herein with reference to the conveying at 110 of methods 100.

Conveying the second discrete wellbore device within the wellbore conduit at 220 may include conveying the second discrete wellbore device within the wellbore conduit while the first discrete wellbore device is located within and/or being conveyed within the wellbore conduit. Thus, the conveying at 220 may be at least partially concurrent with the conveying at 210. Examples of the conveying at 220 are disclosed herein with reference to the conveying at 110 of methods 100.

Transmitting the wireless communication signal at 230 may include transmitting any suitable wireless communication signal between the discrete wellbore device and a given node of the plurality of nodes of the downhole communication network. Examples of the wireless communication signal are disclosed herein.

The transmitting at 230 may include transmitting while the discrete wellbore device is located within the wellbore conduit and/or within a subterranean portion of the wellbore conduit. Thus, the transmitting at 230 may include transmitting through and/or via a wellbore fluid that may extend within the wellbore conduit and/or that may separate the discrete wellbore device from the given node of the downhole communication network. In addition, the transmitting at 230 may be at least partially concurrent with the conveying at 210 and/or with the conveying at 220.

The transmitting at 230 further may include transmitting when, or while, the discrete wellbore device is proximate, or near, the given node of the downhole communication network. In addition, the transmitting at 230 may include transmitting the wireless communication signal from one of the discrete wellbore device and the given node and receiving the wireless communication signal with the other of the discrete wellbore device and the given node.

The transmitting at 230 may include transmitting the wireless communication signal across a transmission distance. Examples of the transmission distance include transmission distances of at least 0.1 centimeter (cm), at least 0.5 cm, at least 1 cm, at least 1.5 cm, at least 2 cm, at least 3 cm, at least 4 cm, at least 5 cm, at least 6 cm, at least 7 cm, at least 8 cm, at least 9 cm, or at least 10 cm. Additional examples of the transmission distance include transmission distances of less than 500 cm, less than 400 cm, less than 300 cm, less than 200 cm, less than 100 cm, less than 80 cm, less than 60 cm, less than 50 cm, less than 40 cm, less than 30 cm, less than 20 cm, less than 10 cm, or less than 5 cm.

The transmitting at 230 may include transmitting any suitable wireless communication signal between the discrete wellbore device and the given node of the downhole communication network. As an example, the transmitting at 230 may include transmitting a wireless depth indication signal from the given node to the discrete wellbore device. As another example, the transmitting at 230 may include transmitting a wireless query signal from the given node to the discrete wellbore device and, responsive to receipt of the wireless query signal, transmitting a wireless status signal from the discrete wellbore device to the given node. Examples of the wireless status signal are disclosed herein.

As indicated in FIG. 4 at 232, the transmitting at 230 may include generating the wireless communication signal with the discrete wellbore device and receiving the wireless communication signal with the given node of the downhole communication network. Responsive to receipt of the wireless communication signal, and as indicated at 234, the method may include generating the data signal with the given node and transferring the data signal toward and/or to the surface region with the downhole communication network. The data signal may be based, at least in part, on the wireless communication signal.

The wireless communication signal that is generated by the discrete wellbore device may include a wireless status signal that is indicative of a status of the discrete wellbore device. Examples of the status of the discrete wellbore device include a temperature proximal the discrete wellbore device within the wellbore conduit, a pressure proximal the discrete wellbore device within the wellbore conduit, a velocity of the discrete wellbore device within the wellbore conduit, a location of the discrete wellbore device within the wellbore conduit, a depth of the discrete wellbore device within the subterranean formation, and/or an operational state of the discrete wellbore device.

As indicated in FIG. 4 at 236, the transmitting at 230 additionally or alternatively may include generating the wireless communication signal with the given node of the downhole communication network and receiving the wireless communication signal with the discrete wellbore device. As indicated at 238 the method further may include transferring the data signal from the surface region to the given node. The given node may generate the wireless communication signal based, at least in part, on the data signal.

Method 200 further may include performing a downhole operation with the discrete wellbore device responsive to receipt of the wireless communication signal by the discrete wellbore device, as indicated in FIG. 4 at 250. Additionally or alternatively, methods 200 may include programming the discrete wellbore device responsive to receipt of the wireless communication signal by the discrete wellbore device, as indicated in FIG. 4 at 260.

As indicated in FIG. 4 at 240, the transmitting at 230 additionally or alternatively may include communicating between the first discrete wellbore device and the second discrete wellbore device by generating the wireless communication signal with the first discrete wellbore device and receiving the wireless communication signal with the second discrete wellbore device. This communication may be at least partially concurrent with the conveying at 210 and/or with the conveying at 220.

The communicating at 240 may include direct transmission of the data signal between the first discrete wellbore device and the second discrete wellbore device. As an example, the communicating at 240 may include generating a direct wireless communication signal with the first discrete wellbore device and (directly) receiving the direct wireless communication signal with the second discrete wellbore device.

The communicating at 240 also may include indirect transmission of the data signal between the first discrete wellbore device and the second discrete wellbore device. As an example, the communicating at 240 may include transmitting a first wireless communication signal from the first discrete wellbore device to a first given node of the downhole communication network. The communicating further may include generating the data signal with the first given node, with the data signal being based upon the first wireless communication signal. The communicating at 240 then may include transferring the data signal from the first given node to a second given node of the downhole communication network, with the second given node being proximate the second discrete wellbore device. Subsequently, the communicating at 240 may include generating a second wireless communication signal with the second given node, with the second wireless communication signal being based upon the data signal. The communicating at 240 then may include transmitting the second wireless communication signal from the second given node to the second discrete wellbore device and/or receiving the second wireless communication signal with the second discrete wellbore device.

Performing the downhole operation at 250 may include performing any suitable downhole operation with the discrete wellbore device. As an example, the discrete wellbore device may include a perforation device that is configured to form a perforation within the wellbore tubular responsive to receipt of a wireless perforation signal from the downhole communication network and/or from the given node thereof. Under these conditions, the transmitting at 230 may include transmitting the wireless perforation signal to the discrete downhole device, and the performing at 250 may include perforating the wellbore tubular.

As additional examples, the discrete wellbore device may include a plug and/or a packer that may be configured to at least partially, or even completely, block and/or occlude the wellbore conduit responsive to receipt of a wireless actuation signal from the downhole communication network and/or from the given node thereof. Under these conditions, the transmitting at 230 may include transmitting the wireless actuation signal to the discrete wellbore device, and the performing at 250 may include at least partially blocking and/or occluding the wellbore conduit.

Programming the discrete wellbore device at 260 may include programming and/or re-programming the discrete wellbore device via the wireless communication signal. As an example, the discrete wellbore device may include a control structure that is configured to control the operation of at least a portion of the discrete wellbore device. Under these conditions, the transmitting at 230 may include transmitting a wireless communication signal that may be utilized by the discrete wellbore device to program and/or re-program the control structure.

Determining the status of the discrete wellbore device at 270 may include determining any suitable status of the discrete wellbore device. When methods 270 include the determining at 270, the transmitting at 230 may include transmitting a wireless query signal to the discrete wellbore device from the downhole communication network and subsequently transmitting a wireless status signal from the discrete wellbore device to the downhole communication network. The wireless status signal may be generated by the discrete wellbore device responsive to receipt of the wireless query signal and may indicate and/or identify the status of the discrete wellbore device. Additionally or alternatively, the determining at 270 may include determining the status of the discrete wellbore device without receiving a wireless communication signal from the discrete wellbore device. Examples of the status of the discrete wellbore device are disclosed herein.

As an example, the determining at 270 may include determining that a depth of the discrete wellbore device within the subterranean formation is greater than a threshold arming depth. Methods 200 then may include performing the transmitting at 230 to transmit a wireless arming signal to the discrete wellbore device responsive to determining that the depth of the discrete wellbore device is greater than the threshold arming depth.

As another example, the determining at 270 additionally or alternatively may include determining that the discrete wellbore device is within a target region of the wellbore conduit. Methods 200 then may include performing the transmitting at 230 to transmit the wireless actuation signal and/or the wireless perforation signal to the discrete wellbore device responsive to determining that the discrete wellbore device is within the target region of the wellbore conduit. Under these conditions, the transmitting at 230 further may include receiving the wireless actuation signal and/or the wireless perforation signal with the discrete wellbore device and performing the downhole operation responsive to receiving the wireless actuation signal and/or the wireless perforation signal.

As yet another example, the determining at 270 additionally or alternatively may include determining that (or if) the downhole operation was performed successfully during the performing at 250. This may include determining that (or if) the perforation device, the plug, and/or the packer was actuated successfully. Under these conditions, the transmitting at 230 may include transmitting a successful actuation signal via the downhole communication network and/or to the surface region responsive to determining that the downhole operation was performed successfully.

As another example, the determining at 270 additionally or alternatively may include determining that (or if) the downhole operation was performed unsuccessfully during the performing at 250. This may include determining that (or if) the perforation device, the plug, and/or the packer was actuated unsuccessfully. Under these conditions, the transmitting at 230 may include transmitting an unsuccessful actuation signal via the downhole communication network and/or to the surface region responsive to determining that the downhole operation was performed unsuccessfully.

As yet another example, the determining at 270 additionally or alternatively may include determining that (or if) the discrete wellbore device is experiencing a fault condition. Under these conditions, the transmitting at 230 may include transmitting a wireless fault signal from the discrete wellbore device to the downhole communication network responsive to determining that the discrete wellbore device is experiencing the fault condition. In addition, methods 200 further may include disarming the discrete wellbore device responsive to determining that the discrete wellbore device is experiencing the fault condition. This may include transmitting a wireless disarming signal to the discrete wellbore device from the surface region, via the downhole communication network, and/or from the given node of the downhole communication network.

Methods 200 also may include aborting operation of the discrete wellbore device responsive to determining that the discrete wellbore device is experiencing the fault condition and/or determining that the downhole operation was performed unsuccessfully. Under these conditions, the transmitting at 230 may include transmitting a wireless abort signal to the discrete wellbore device from the surface region, via the downhole communication network, and/or from the given node of the downhole communication network. In the context of a wellbore tool that includes a perforation device, the aborting may include sending a disarm command signal to the discrete wellbore device or otherwise disarming the perforation device.

Methods 200 also may include initiating self-destruction of the discrete wellbore device responsive to determining that the discrete wellbore device is experiencing the fault condition and/or determining that the downhole operation was performed unsuccessfully. Under these conditions, the transmitting at 230 may include transmitting a wireless self-destruct signal to the discrete wellbore device from the surface region, via the downhole communication network, and/or from the given node of the downhole communication network.

Transferring the data signal at 280 may include transferring the data signal along the wellbore conduit, from the surface region, to the subterranean formation, from the subterranean formation, and/or to the surface region via the downhole communication network and may be performed in any suitable manner. As an example, the plurality of nodes may be spaced apart along the wellbore conduit by a node-to-node separation distance, and the transferring at 280 may include transferring between adjacent nodes and across the node-to-node separation distance. Examples of the node-to-node separation distance are disclosed herein. As disclosed herein, the transferring at 280 may include wired or wireless transfer of the data signal, and examples of the data signal are disclosed herein.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A system for using a discrete wellbore device, the system comprising:

a wellbore tool configured to perform a downhole operation within a wellbore conduit that is defined by a wellbore tubular, wherein the wellbore tubular extends within a subterranean formation and the wellbore tool is configured to be conveyed and operated within the wellbore in an untethered manner;

an acoustic downhole communication network comprising a plurality of acoustic transmission nodes that extends along the wellbore tubular and at least one of the plurality of acoustic transmission nodes is in electronic communication with an acoustic receiver at a known location along the wellbore tubular for receiving acoustic signals from within the wellbore tubular, wherein the plurality of downhole transmission nodes comprise a series of nodes provided on the wellbore tubular, each node includes an acoustic transmission receiver, an acoustic transmission transmitter, and utilizes the wellbore tubular to transmit an acoustic transmission signal from one of the plurality of nodes to another of the plurality of nodes;

performing the downhole operation with the wellbore tool, wherein performance of the downhole operation produces an acoustic signal within the wellbore in response to the performance;

receiving the produced acoustic signal from the wellbore tool by the acoustic receiver; and communicating another acoustic signal related to the received acoustic signal from the wellbore along the wellbore tubular using the plurality of acoustic transmission nodes and the wellbore tubular as an acoustic transmission medium between nodes;

receiving the communicated another acoustic signal at a surface location; and performing another downhole operation within the wellbore in response to the received acoustic signal.

2. The system of claim 1, wherein performing the downhole operation with the wellbore tool includes at least one of perforating the wellbore tubular and setting a plug within the wellbore tubular, and wherein performing the another downhole operation includes performing at least one of a stimulation operation and a perforating operation.

3. The system of claim 1, wherein the wellbore tool further comprises an acoustic communication device coupled with the wellbore tool for movement within the wellbore conduit with the wellbore tool, wherein the acoustic communication device is configured to acoustically communicate with the acoustic downhole communication network.

4. The system of claim 1, wherein receiving the communicated acoustic signal at a surface location further comprises evaluating the received communicated acoustic signal to affirm that the wellbore tool performed the downhole operation.

5. The system of claim 1, wherein the discrete wellbore device further includes a control structure configured to be conveyed with the wellbore tool within the wellbore conduit and to control the operation of the discrete wellbore device, wherein the control structure is programmed to:

(i) determine that an actuation criterion has been satisfied; and (ii) provide an actuation signal to the wellbore tool responsive to satisfaction of the actuation criterion, wherein the wellbore tool is configured to perform the downhole operation responsive to receipt of the actuation signal.

6. The system of claim 5, wherein the discrete wellbore device further includes a detector configured to detect at least one of a downhole parameter and a parameter of the discrete wellbore device.

7. The system of claim 5, wherein the control structure is programmed to autonomously control determining location of the wellbore tool within the wellbore tubular.

* * * * *